US011370592B2

(12) United States Patent
Wang et al.

(10) Patent No.: US 11,370,592 B2
(45) Date of Patent: Jun. 28, 2022

(54) VACUUM FRESHNESS PRESERVATION CONTAINER THAT CAN BE PRESSED ON TWO SIDES

(71) Applicant: Shenzhen Jingding Packaging Materials Co., Ltd., Guangdong (CN)

(72) Inventors: Tao Wang, Guangdong (CN); Amy Lee, Guangdong (CN); Guangzhi Luo, Guangdong (CN)

(73) Assignee: Shenzhen Jingding Packaging Materials Co., Ltd., Guangdong (CN)

( * ) Notice: Subject to any disclaimer, the term of this patent is extended or adjusted under 35 U.S.C. 154(b) by 66 days.

(21) Appl. No.: 17/035,714

(22) Filed: Sep. 29, 2020

(65) Prior Publication Data

US 2021/0155392 A1 May 27, 2021

Related U.S. Application Data

(63) Continuation of application No. PCT/CN2020/108539, filed on Aug. 12, 2020.

(30) Foreign Application Priority Data

Nov. 26, 2019 (CN) ..... 201922085091.4

(51) Int. Cl.
*B65D 81/20* (2006.01)
*B65D 51/16* (2006.01)

(52) U.S. Cl.
CPC ..... *B65D 81/2038* (2013.01); *B65D 51/1644* (2013.01)

(58) Field of Classification Search
CPC ..... B65D 81/2038; B65D 51/1644; B65D 31/02; B65D 31/04; B65D 31/041–048; B65D 31/06
(Continued)

(56) References Cited

U.S. PATENT DOCUMENTS 2,890,810 A * 6/1959 Rohling ..... B65B 31/00 206/508
3,805,788 A * 4/1974 Kleiner ..... A61M 1/0001 604/320
(Continued)

FOREIGN PATENT DOCUMENTS

CN 2322925 Y * 6/1999
CN 202897173 U * 4/2013
(Continued)

OTHER PUBLICATIONS

"International Search Report (Form PCT/ISA/210) of PCT/CN2020/108539," dated Nov. 13, 2020, pp. 1-5.

*Primary Examiner* — Chun Hoi Cheung
*Assistant Examiner* — Brijesh V. Patel
(74) *Attorney, Agent, or Firm* — Cooper Legal Group, LLC

(57) ABSTRACT

A vacuum freshness preservation container that can be pressed on two sides provided in this application includes a container body and container cove. The container cover has chambers disposed symmetrically, a piston is slidably disposed in each chamber, and each chamber has an air outlet which communicates with an interior of the container body and where a first check valve is disposed. The piston is provided with an air discharge structure that communicates the chamber with an outside when the piston moves toward the first check valve, and the container cover is provided with a linkage mechanism such that the two pistons move in opposite directions. By alternately pressing pistons in two chambers, the chambers always keep in a vacuumizing state, thereby achieving a higher efficiency.

16 Claims, 9 Drawing Sheets

(58) Field of Classification Search
USPC ..... 220/203.1, 212, 203.19, 202, 203.01, 220/203.04, 203.07, 203.13, 203.15, 220/203.16, 203.18, 203.23, 203.27, 220/203.29; 215/228, 311, 260, 262, 215/315; 141/65, 95, 192; 417/437; 99/472; 222/152, 383.1
See application file for complete search history.

(56) References Cited

U.S. PATENT DOCUMENTS 3,943,987 A * 3/1976 Rossi ..... B65D 81/2015 206/524.8
4,051,971 A * 10/1977 Saleri ..... B65D 81/2038 99/476
4,372,096 A * 2/1983 Baum ..... B67B 3/24 53/103
5,406,992 A * 4/1995 Miramon ..... A47G 19/2272 220/203.02
5,546,997 A * 8/1996 Miramon ..... B65D 81/20 53/88
5,803,282 A * 9/1998 Chen ..... B65B 31/047 220/DIG. 16
5,806,575 A * 9/1998 Tsay ..... B65D 81/2015 141/192
6,547,845 B2 * 4/2003 Grant, Sr. ..... B01D 46/0004 312/236
6,557,462 B1 * 5/2003 Wang ..... A47J 47/10 219/735
6,637,321 B2 * 10/2003 Wang ..... B65D 81/2038 220/203.07
6,644,489 B2 * 11/2003 Chang ..... B65D 81/2038 215/311
6,830,081 B1 * 12/2004 Chen ..... F04B 35/04 220/203.19
6,968,870 B1 * 11/2005 Tsay ..... F04B 35/01 220/203.19
6,994,227 B2 * 2/2006 Kwon ..... B65D 81/2038 220/203.11
7,571,748 B2 * 8/2009 Shao ..... B65B 31/00 206/524.8
8,113,246 B2 * 2/2012 Hsieh ..... B65D 81/2038 220/203.01
2005/0051551 A1 * 3/2005 Galletti ..... B65D 81/2038 220/212
2005/0244293 A1 11/2005 Lin et al.
2007/0272325 A1 * 11/2007 Tsay ..... B01J 3/03 141/65
2008/0078466 A1 * 4/2008 Wang ..... B65D 81/2038 141/65
2017/0166383 A1 * 6/2017 Moon ..... B65D 81/2015
2017/0190496 A1 * 7/2017 Yang ..... B65D 43/02

FOREIGN PATENT DOCUMENTS

CN 203486343 3/2014
CN 205366586 U * 7/2016
CN 205525840 U * 8/2016
CN 106865017 A * 6/2017 ..... B65D 45/20
CN 108910307 A * 11/2018
CN 109311582 2/2019
CN 209473964 10/2019
CN 110758913 A * 2/2020 ..... B65D 45/20
CN 210972307 7/2020
JP H0579457 3/1993
KR 20190054760 5/2019

* cited by examiner

VACUUM FRESHNESS PRESERVATION CONTAINER THAT CAN BE PRESSED ON TWO SIDES

CROSS-REFERENCE TO RELATED APPLICATION

The present application is a continuation of international PCT application serial No. PCT/CN2020/108539 filed on Aug. 12, 2020, which claims the priority benefit of China application No. 201922085091.4 filed on Nov. 26, 2019. The entirety of the above-mentioned patent application is incorporated herein by reference and made a part of this specification.

BACKGROUND

Technical Field

This application relates to a freshness preservation container, and more particularly, to a vacuum freshness preservation container that can be pressed on two sides.

Description of Related Art

With the development of society and advancement of technology, higher requirements for the quality and time of food preservation are put forward. In order to keep the food in the container fresh, air in the container is usually drawn out to form a vacuum, so as to achieve food preservation. The freshness preservation container is generally a container that assumes to be sealed. That is, the container is sealed to prevent the air from entering the container from the outside, so as to achieve food preservation. For the freshness preservation container having this structure, the container is isolated from access of air from outside, there is still air in the container, and oxygen in the air oxidizes the food, thereby affecting the freshness of the food and limiting the preservation time.

There are vacuum freshness preservation containers available on the market, for example, a Chinese Application Publication No. CN203486343U discloses a manually vacuumized freshness preservation container including a container body and a container cover that fits with and seals the container body. The container cover includes a face shell and a bottom shell which are snapped together. A surface of the face shell has an air inlet that passes through the face shell, and the bottom of the bottom shell has an air pumping through-hole and an air entering through-hole that pass through the bottom shell. The air entering through-hole extends upwards to the air inlet, an air pumping through-hole plug is disposed at the bottom of the air pumping through-hole, and a second sealing ring is disposed at the top of the air pumping through-hole together with a manually pumped device in a sealing way. For this new type of vacuum freshness preservation container, a pump handle is manually operated, which is simple and convenient, and vacuumizing can be achieved without any additional vacuumizing equipment, such that the container is in a vacuum state, which effectively prevents the outside air from entering the vacuum freshness preservation container, so as to ensure the effect of preservation. However, each time it is vacuumized, the pump handle needs to be operated continually, resulting in low efficiency.

SUMMARY

This application is provided with a vacuum freshness preservation container that can be pressed on two sides which has high vacuumizing efficiency.

A vacuum freshness preservation container that can be pressed on two sides includes a container body and a container cover. The container cover has chambers disposed symmetrically, a piston is slidably disposed in each chamber, and each chamber has an air outlet which communicates with an interior of the container body and where a first check valve is disposed. The piston is provided with an air discharge structure that communicates the chamber with an outside when the piston moves toward the first check valve, and the container cover is provided with a linkage mechanism such that the two pistons move in opposite directions.

By disposing symmetrical chambers in which pistons are linked to move in opposite directions, when the freshness preservation container needs to be vacuumized, the piston in one of the chambers is pressed to move toward the first check valve, and air in the chamber is drawn out. At the same time, the piston in the other chamber is linked to move up, and when the piston moves up, a negative pressure is generated in a closed cavity formed between the piston and a bottom wall of the chamber to open the first check valve, thereby achieving vacuumizing of the container body. By alternately pressing pistons in two chambers, the freshness preservation container always keeps in a vacuumizing state, thereby achieving a higher efficiency.

Further, the linkage mechanism includes a connecting rod with a middle portion connected to the container cover in a way that the middle portion is slidable relative to the container cover and two ends respectively hinged to the pistons.

The connecting rod achieves linkage in opposite directions for two pistons. The structure is simple and easy to achieve, which also contributes to subsequent production and processing and effectively reduces production costs.

Further, the container cover has a mounting groove where the connecting rod is disposed, a top wall of the container cover has vertical slots which communicate with the chambers and are disposed above the chambers, and pushing blocks fixed at both ends of the connecting rod are disposed in vertical slots.

In this way, by pressing the pushing blocks, pistons move down, such that the pressing operation is simple and convenient.

Further, when the two pushing blocks are at the same height, top surfaces of the pushing blocks are flush with a top surface of the container cover, and elastic members are disposed in the vertical slots to drive the pushing blocks to be flush with the top surface of the container cover.

In this way, when the freshness preservation container is not in a vacuumizing state, under the action of the elastic members, symmetrical pushing blocks are at the same height, and top surfaces of the pushing blocks are flush with the top surface of the container cover, which can maintain the flatness of the top surface of the container cover, and the overall appearance is more flat and beautiful.

Further, the air discharge structure includes an annular groove, a gasket ring and a vent. A side wall of the piston has the annular groove at which the gasket ring is sleeved, the annular groove is formed with the vent communicating with the outside, and a width of the annular groove and a width of the vent are greater than a wire diameter of the gasket ring.

In this way, when the piston moves toward the first check valve, the gasket ring is pushed to move away from the first check valve, at this time, the vent is exposed, such that the air in the closed cavity can be discharged through the vent. When the piston moves away from the first check valve, the gasket ring is pushed to move toward the first check valve, at this time, the gasket ring plays a role of sealing, such that air in the closed cavity cannot be discharged through the vent, and a negative pressure is generated in the closed cavity to open the first check valve.

Further, the container cover has an air inlet where a second check valve is disposed.

When the container body is vacuumized and the container cover is difficult to be opened, by opening the second check valve to allow the outside air to get into the container body, the container cover can be opened smoothly.

Further, a pressure detecting member is mounted to the container cover.

The pressure detecting member plays a role of indicating, and the degree of vacuumizing in the container body can be detected by the pressure detecting member during the vacuumizing process.

Further, the container body is provided with a rim on which a sealing ring abutting against the container cover is sleeved.

First, the sealing ring can improve the sealing of a position where the container body and the container cover are connected, and prevent the outside air from entering the container body through the position where the container body and the container cover are connected. At the same time, the rim can play a role of positioning the sealing ring, and the sealing ring can be disassembled for cleaning and replacement.

Further, the container cover is provided with hinged hasps on both sides, and the container body is provided with fastening blocks for the hasps to be snapped into.

By snap connecting the container cover into the container body, detachable connection is achieved. The assembly or disassembly can be achieved by only turning the hasps. The structure is simple, and the assembly and disassembly are convenient and quick.

Further, the container body is provided with a pressing strip for pressing each pushing block, and one end of each pressing strip is rotatably connected to the container cover.

When the freshness preservation container does not need to be vacuumized, the pressure strips are turned to press the pushing blocks, such that the pushing blocks can maintain the current state stably and will not move up and down.

Further, the linkage mechanism includes a face cover which is detachably connected to one side of the connecting rod facing away from the face cover.

On the one hand, the face cover can protect the connecting rod and the pistons from being damaged, and on the other hand, it is also convenient for a user to operate.

Further, the container cover has an accommodating slot where the connecting rod and the face cover are located, and there is a gap between the face cover and a wall of the accommodating slot.

It can protect the connecting rod and the face cover to some extent, such that the connecting rod and the face cover are not easily to be damaged.

Further, the container cover has an air inlet where a fourth check valve is disposed; the face cover is provided with a button, and a transmission member is disposed between the button and the fourth check valve; and the button is pressed to open the fourth check valve.

As the container body is vacuumized and is difficult to be opened, by pressing the button to open the fourth check valve, the outside air enters the container body, and the container cover can be easily opened.

Further, the fourth check valve includes a connecting portion that passes through the air inlet, an anti-drop portion connected to the connecting portion at one end facing the accommodating slot, and a sealing portion connected to the connecting portion at one end away from the accommodating slot. An air leakage groove runs through side walls of the connecting portion and the anti-drop portion to the sealing portion.

Further, an elastic member is fixedly connected to a side wall of the transmission member, a supporting member is fixedly connected to the container cover, and one end of the elastic member away from the transmission member is connected to the supporting member.

The supporting member and the elastic member can fix and limit the transmission member, such that the transmission member is not easy to be removed from the position between the button and the fourth check valve.

Further, the air discharge structure has a valve mounting hole located on the piston and a third check valve disposed in the valve mounting hole.

When the piston moves toward the first check valve, the closed cavity communicates with the outside under the action of the air discharge structure, and when the piston moves away from the first check valve, the closed cavity is formed between the piston and the bottom wall of the chamber under the action of the air discharge structure.

In summary, this application has the following advantages.

By disposing symmetrical chambers and pistons and disposing the connecting rod by which two pistons are linked to move in opposite directions, the chambers always keep in a vacuumizing state by alternatively pressing driving members in two chambers, which improves the vacuumizing efficiency. When the freshness preservation container is not in a vacuumizing state, under the action of the elastic members, it can maintain the flatness of the top surface of the container cover, such that the overall appearance is flat and beautiful.

DESCRIPTION OF THE EMBODIMENTS

This application is described in detail below in combination with FIGS. 1-10.

The embodiments of this application provide a vacuum freshness preservation container that can be pressed on two sides.

Embodiment I

Figure 1:
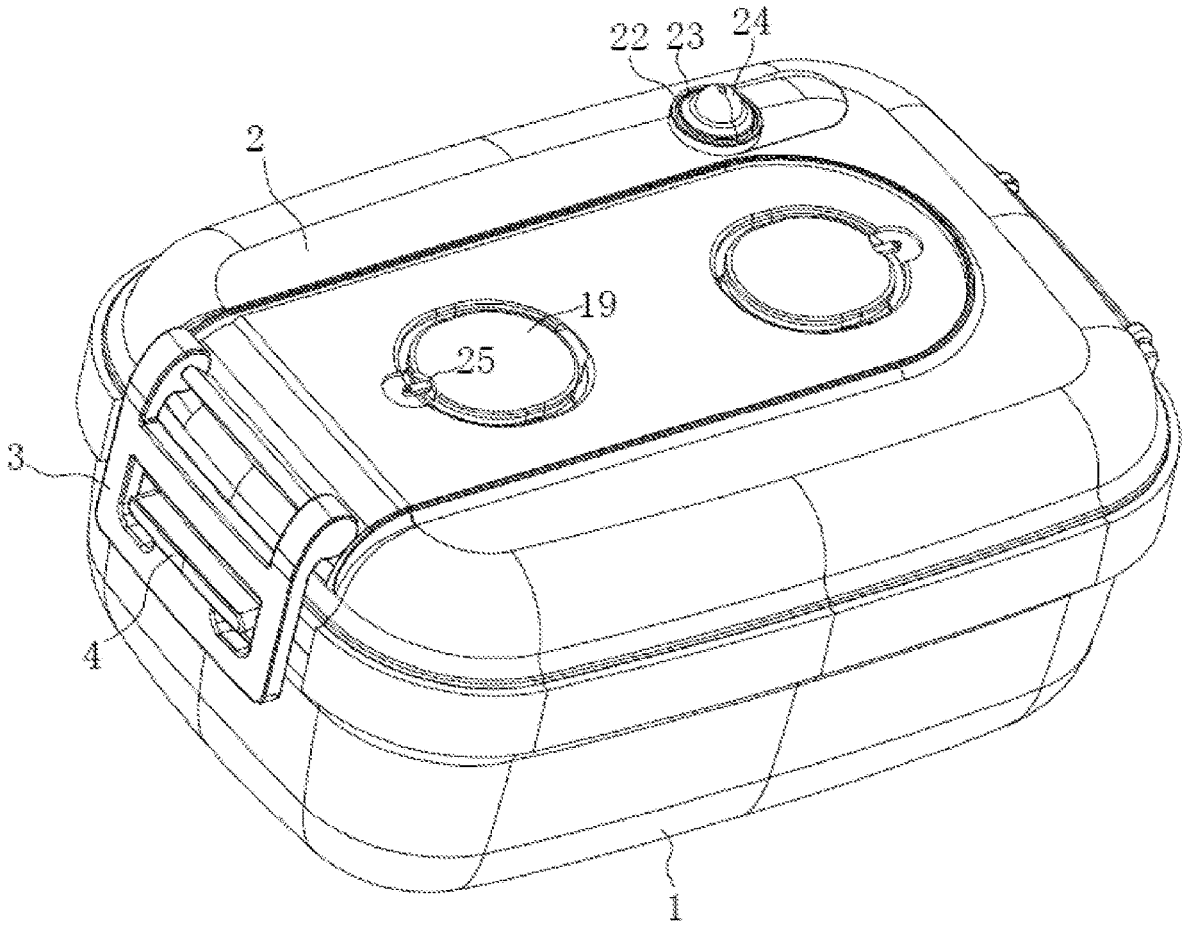
FIG. 1 is a schematic view of an overall structure of Embodiment I of this application.
Figure 2:
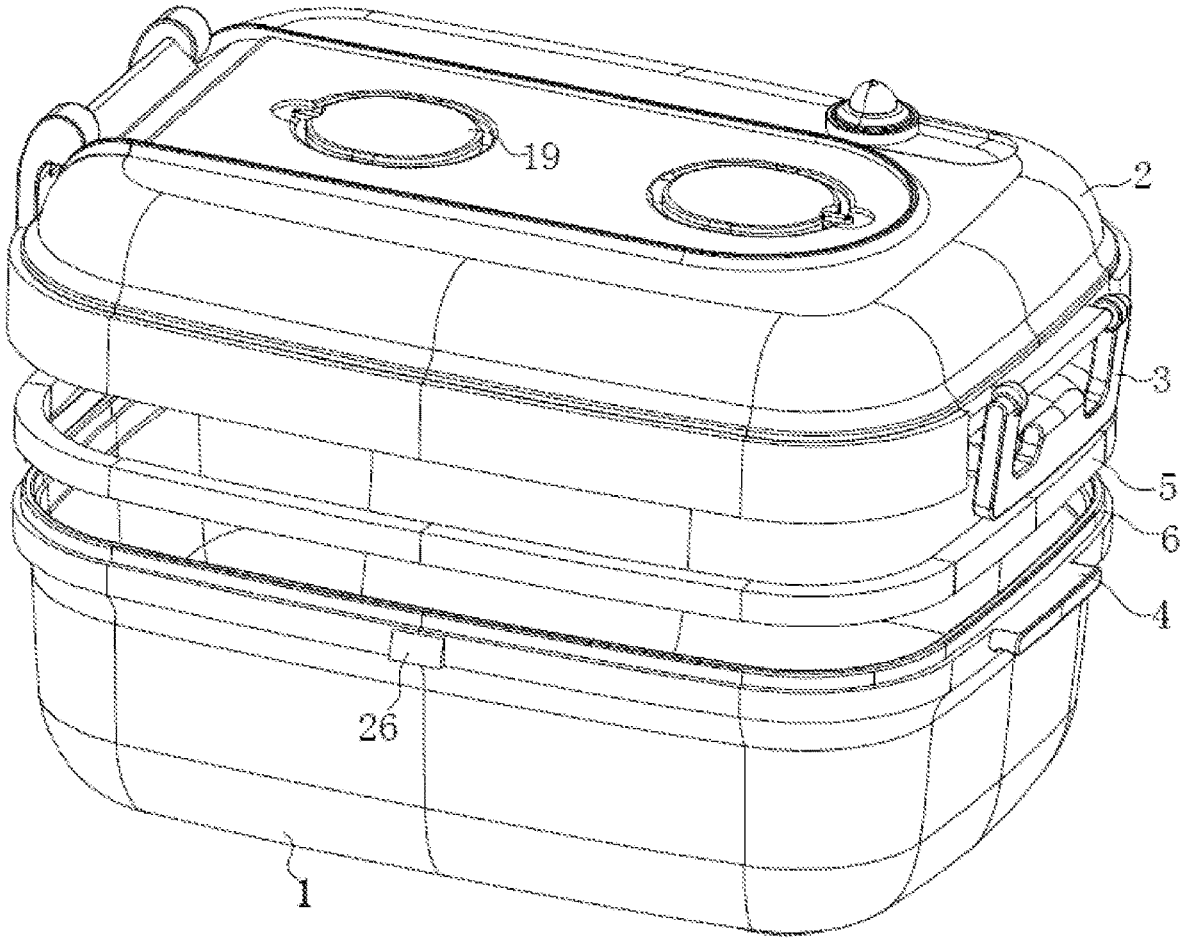
FIG. 2 is an exploded view of Embodiment I of this application.

A vacuum freshness preservation container that can be pressed on two sides, as shown in FIG. 1 and FIG. 2, includes a container body 1 and a container cover 2 which are connected in snap fit fashion to achieve fixation. The container cover 2 is provided with hinged hasps 3 on both sides, at the same time, the container body 1 is provided with fastening blocks 4 correspondingly for the hasps 3 to be snapped into, so as to achieve detachable connection between the container cover 2 and the container body 1, and assembly and disassembly are convenient and quick. In order to improve the sealing between the container cover 2 and the container body 1, a sealing ring 5 is arranged between the container body 1 and the container cover 2, a top wall of the container body 1 is provided with a rim 6, and the sealing ring 5 has a recess engaging with the rim 6, such that the sealing ring 5 can be stably mounted to the container body 1, and when the container cover 2 is fixed with the container body 1, an edge of the container cover 2 presses the sealing ring 5 tightly to ensure the sealing, which ensures that air from the outside cannot get into the container body 1.

Figure 3:
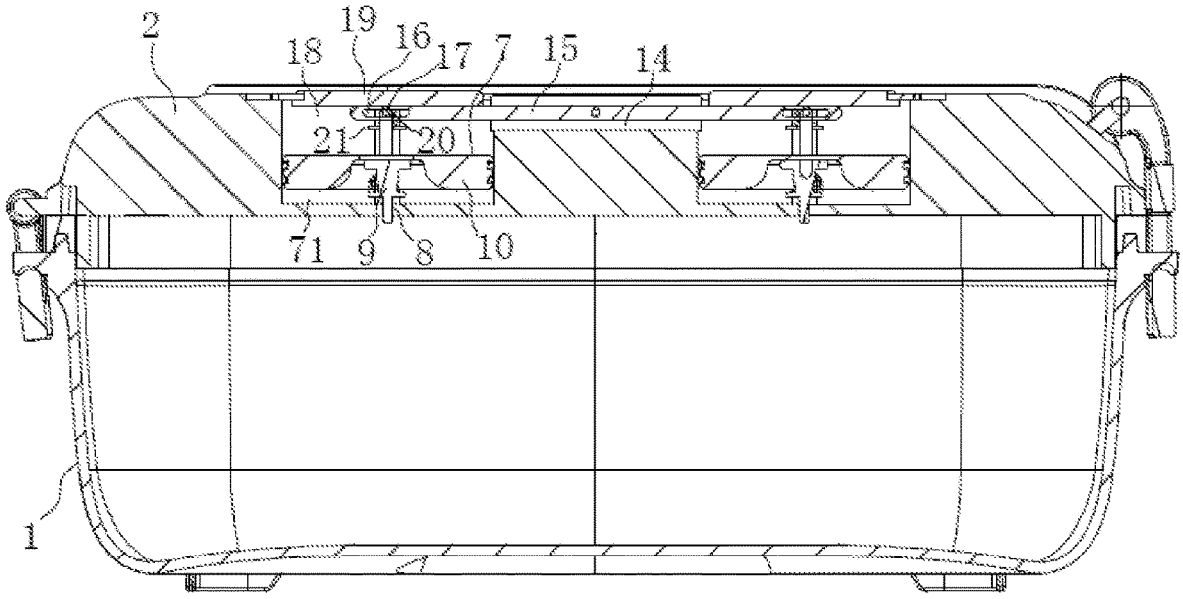
FIG. 3 is a sectional view of Embodiment I of this application.

As shown in FIG. 1 and FIG. 3, the container cover 2 has two chambers 7 disposed symmetrically. The bottom of each chamber has an air outlet 8 which communicates with an interior of the container body 1 and where a first check valve 9 allowing the air to enter only from the container body 1 into the chambers 7 is disposed. A piston 10 is slidably disposed in each of the two chambers 7. The piston 10 is provided with an air discharge structure that communicates the chamber 7 with the outside when the piston 10 moves toward the first check valve 9, that is, when the piston 10 moves toward the first check valve 9, the chamber 7 communicates with the outside, and when the piston 10 moves away from the first check valve 9, a closed cavity 71 is formed between the piston 10 and a bottom wall of the chamber 7. By driving the piston 10 to move back and forth, the air in the container body 1 can be continuously drawn out to achieve a vacuum. In this way, without any additional tools, the freshness preservation container itself has a vacuumizing function, therefore the usage is more convenient and practicability is better.

Figure 4:
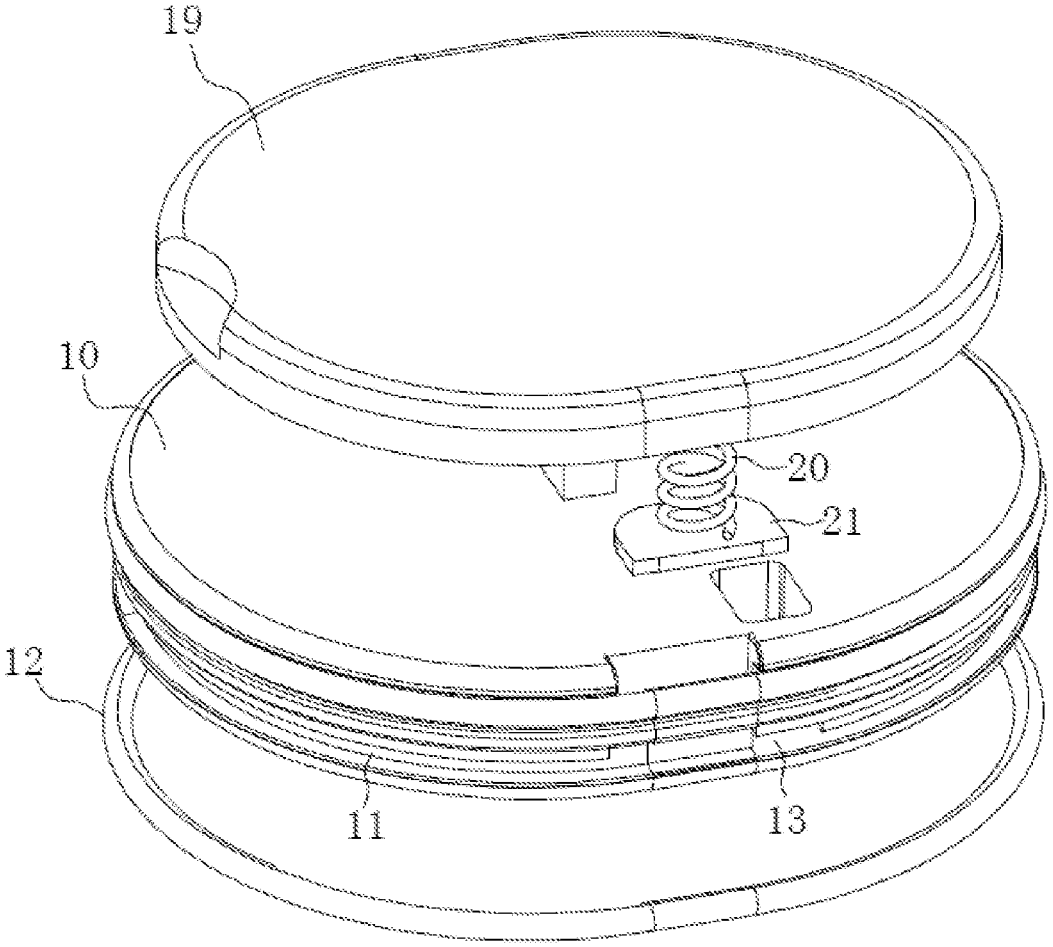
FIG. 4 is a structural view showing a piston and a pushing block of Embodiment I of this application.

As shown in FIG. 3 and FIG. 4, the air discharge structure includes an annular groove 11, a gasket ring 12 and a vent 13, wherein a side wall of the piston 10 has the annular groove 11 on which the gasket ring 12 is sleeved, and the annular groove 11 is formed with the vent 13 communicating the closed cavity 71 with the outside. The width of the annular groove 11 is greater than the wire diameter of the gasket ring 12, and the width of the vent 13 is consistent with that of the annular groove 11. In this way, when the piston 10 moves away from the first check valve 9, under the action of an inner wall of the chamber 7, the gasket ring 12 moves close to the first check valve 9 in the annular groove 11, at this time, the gasket ring 12 seals the vent 13, such that the closed cavity 71 is in a closed state to achieve vacuumizing. When the piston 10 slides toward the first check valve 9, under the action of the inner wall of the chamber 7, the gasket ring 12 moves away from the first check valve 9 in the annular groove 11, at this time, the vent 13 is exposed, such that the air in the closed cavity 71 can be discharged, which facilitating the subsequent vacuumizing. As shown in FIG. 1 and FIG. 3, the container cover 2 has a mounting groove 14 where a linkage mechanism is arranged to be linked to the pistons 10 at both ends, which move in opposite directions. The linkage mechanism includes a connecting rod 15 with a middle portion connected at an inner wall of the mounting groove 14 in a way that the middle portion is slidable relative to the mounting groove 14 and two ends respectively hinged to the pistons 10. Each of two ends of the connecting rod 15 has a strip-shaped slot 16 in which a hinge shaft 17 of the piston 10 is slidably disposed. When the container body 1 needs to be vacuumized, by pressing the piston 10 to move down, the other piston 10 can be linked to move up for vacuumizing, and the air in the chamber 7 where the piston 10 moves down is drawn out. By alternately pressing pistons 10 in two chambers 7, the chambers 7 always keep in a vacuumizing state, thereby achieving a higher efficiency.

As shown in FIG. 3 and FIG. 4, the container cover 2 has vertical slots 18 which communicate with the outside and disposed above the corresponding chambers 7, and pushing blocks 19 fixed at both ends of the connecting rod 15 are disposed in vertical slots 18 allowing a gap provided between the pushing block 19 and an inner wall of the vertical slot 18. When the two pushing blocks 19 are at the same height, top surfaces of the pushing blocks 19 are flush with a top surface of the container cover 2. Elastic members 20 are disposed in the vertical slots 18 to drive the two pushing blocks 19 to return to positions with the same height, and the elastic member 20 includes a spring. A protruded plate 21 is disposed at the inner wall of each vertical slot 18, one end of the spring is fixed at the protruded plate 21, and the other end thereof is fixed at the pushing block 19, such that after the pushing block 19 is pushed to move down and then released, the pushing block 19 will return to the original position under restoring force of the spring, which can make the surface of the container cover 2 more flat and aesthetic. Moreover, after the pushing block 19 is released, with the help of the restoring force of the spring, vacuumizing to a certain extent can be achieved, which makes the entire vacuumizing easy and labor-saving. The container body 2 is provided with a pressing strip 25 (as shown in FIG. 1) for pressing a top wall of each pushing block 19, and one end of each pressing strip 25 is connected to the container cover 2 in a way that the pressing strip is rotatable relative to the container cover 2; and when the freshness preservation container does not need to be vacuumized, the pressure strips 25 are turned to press the pushing blocks 19, such that the pushing blocks 19 can maintain the current state stably and will not move up and down.

As shown in FIG. 1, the container cover 2 has an air inlet 22 which communicates with the interior of the container body 1 and in which a second check valve 23 is disposed. The second check valve 23 includes a rubber plug body, and by using the rubber plug body to block the air inlet 22, the second check valve 23 allows air to only enter into the container body 1 from the outside. In this way, when the container body 1 is in the vacuum state and the container cover 2 cannot be opened, by opening the second check valve 23 to allow the outside air to get into the container body 1, the container cover 2 can be opened smoothly. A pressure detecting member 24 is mounted to the container cover 2, and in this embodiment, the pressure detecting member 24 is a rubber protrusion which is hollow inside.

The rubber protrusion is formed integrally with the rubber plug body, and an interior of the rubber protrusion communicates with the container body 1, such that after the container body 1 is vacuumized, the rubber protrusion is collapsed downwardly, and users can in time know that the container body 1 has been vacuumized, which plays a role of indicating. In addition, the rubber protrusion and rubber plug body are integrally formed to decrease the number of parts and effectively reduce the cost.

As shown in FIG. 2, an engaging block 26 which is wedge-shaped is disposed on an outer wall of the container body 1 on the long-side. An inner wall of the container cover 2 has an engaging slot (not shown in the figure) engaged with the engaging block 26. After the container cover 2 fits with the container body 1, by engagement between the engaging block 26 and the engaging slot, the long-side of the container body 1 can be fixed, such that the container cover 2 and the container body 1 can be well fixed, which prevents the long-side of the container body 1 from deforming.

The implementation principle of this embodiment is as follow. First the container cover 2 fits over the container body 1, and the two are fixed together by connecting the hasp 3 with the fastening block 4 in a snap fit fashion. Then one of the pushing blocks 19 is presses to move down, which drives the piston 10 in the chamber 7 to move down, thereby discharging the air in the closed cavity 71. At the same time, the connecting rod 15 is linked to the piston 10 in the other chamber 7 to move up, and when the piston 10 moves up away from the first check valve 9, a negative pressure is generated in the closed cavity 71 to open the first check valve 9, thereby achieving vacuumizing of the container body 1. After the pushing block 19 is released, it will return to the original position under the action of the spring, and the two pushing blocks 19 are alternately pressed to continuously vacuumizing the container body 1. When the container cover 2 needs to be opened later, the hasp 3 and the fastening block 4 are detached first, and then the second check valve 23 is opened such that the air gets into the container body 1 from the outside, at this time the container cover 2 can be opened normally.

Embodiment II

Figure 5:
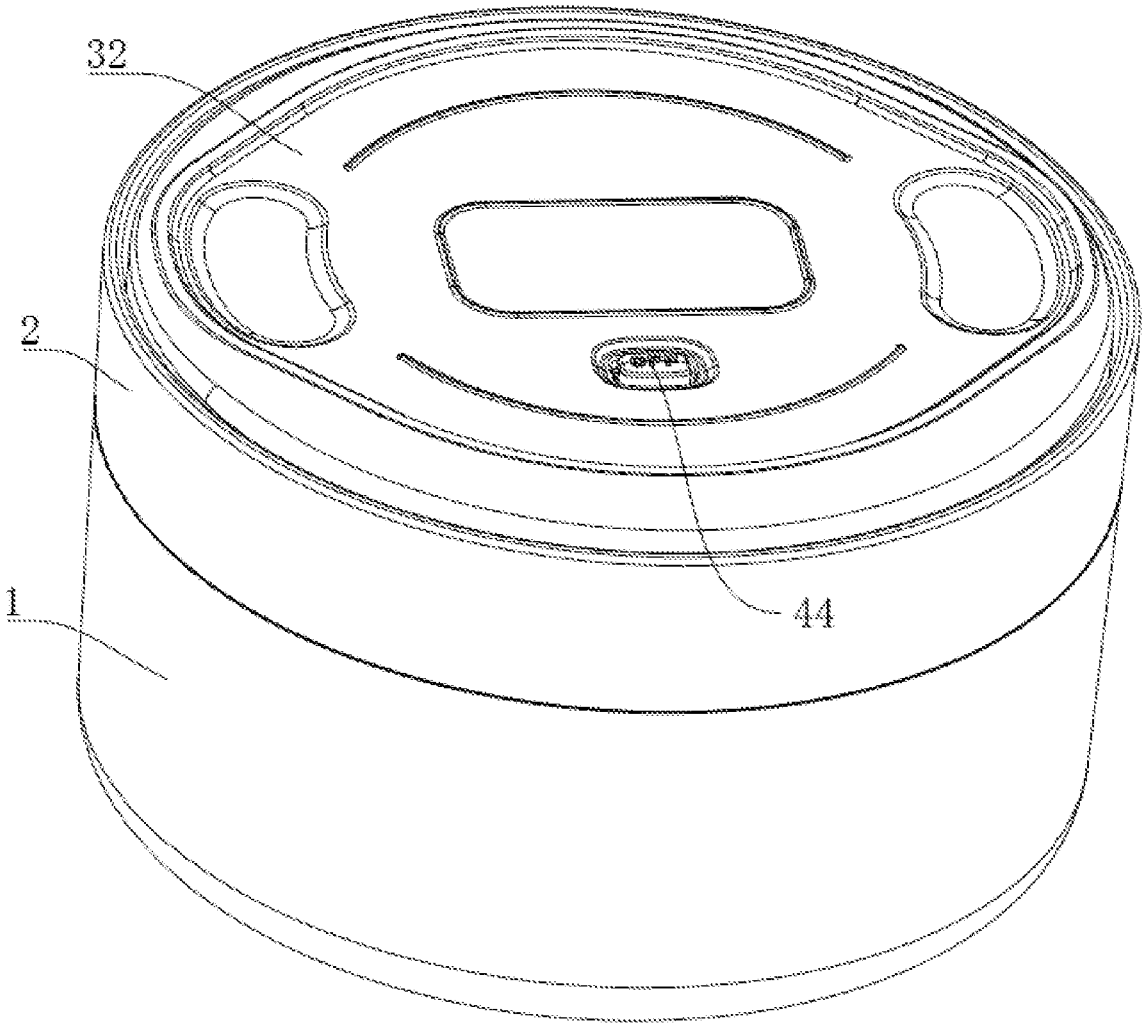
FIG. 5 is a schematic view of an overall structure of Embodiment II of this application.
Figure 6:
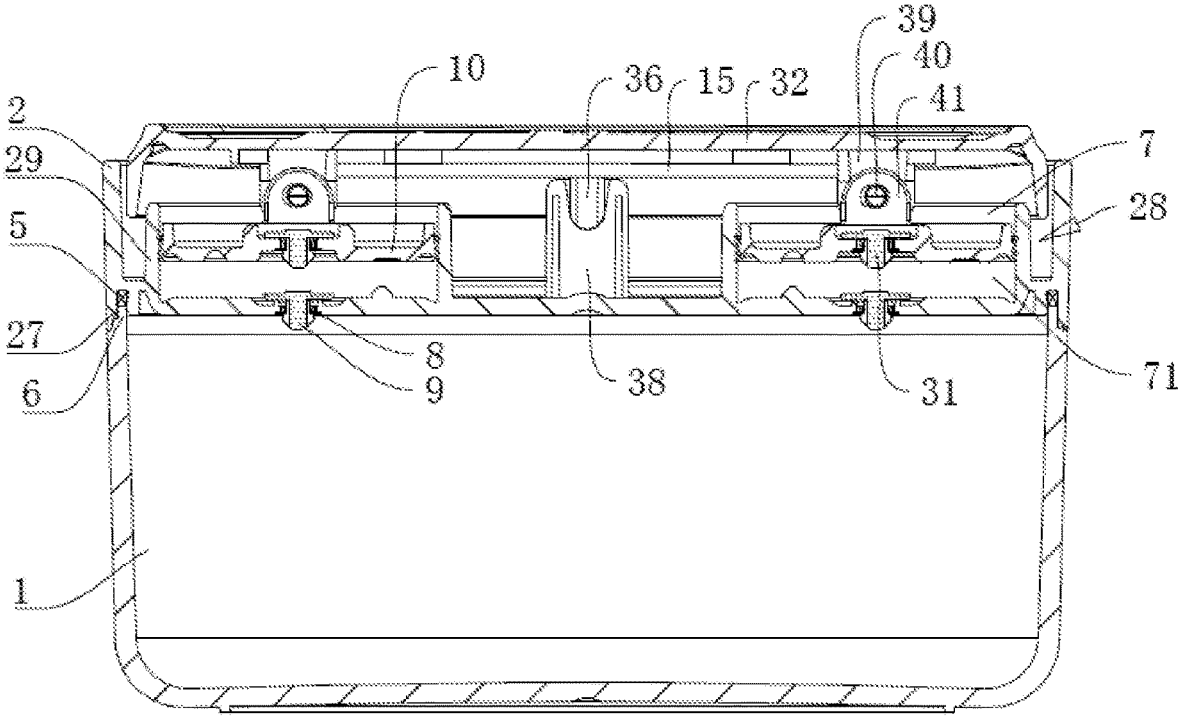
FIG. 6 is a sectional view of Embodiment II of this application.

A vacuum freshness preservation container that can be pressed on two sides, referring to FIG. 5 and FIG. 6, includes a container body 1 and a container cover 2, and the container body 1 fits with the container cover 2 by inserting the container body 2 into the container cover 2. A rim 6 is integrally formed at a top wall of the container body 1, a bottom wall of the container cover 2 has an insertion slot 27 that fits with the rim 6 by inserting the rim 6 into the insertion slot 27, and a sealing ring 5 is embedded into the bottom of the insertion slot 27. When the container cover 2 fits with the container body 1, the rim 6 is inserted into the insertion slot 27 and abuts against the sealing ring 5 so as to ensure that air from the outside cannot enter into the container body 1.

Figure 7:
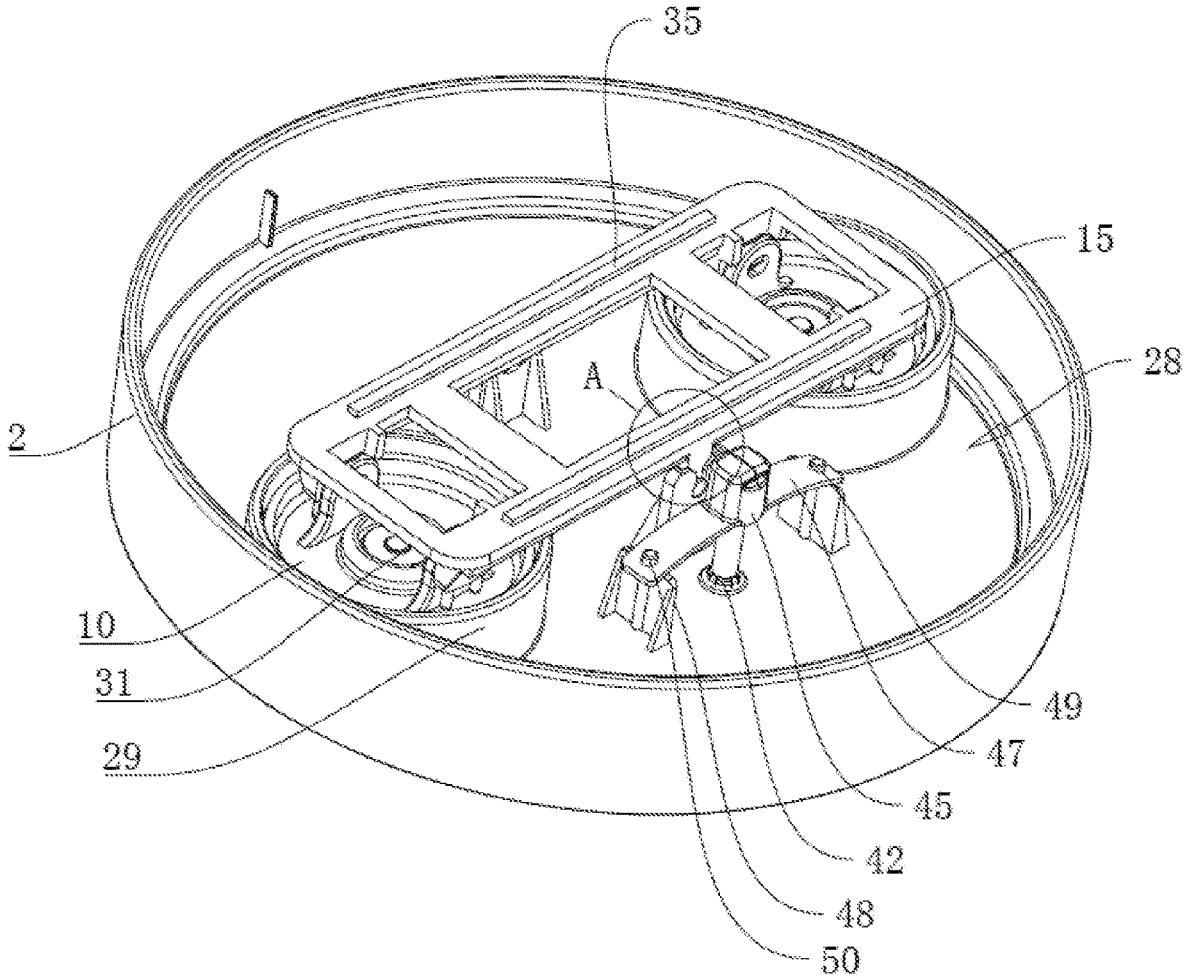
FIG. 7 is a schematic view showing a linkage mechanism of Embodiment II of this application.

Referring to FIG. 6 and FIG. 7, the container cover 2 has an accommodating slot 28 at the top, two guiding rings 29 which located at the bottom of the accommodating slot 28 are formed integrally with the container cover 2, and chambers 7 communicating with the accommodating slot 28 are formed in the guiding rings 29. The container cover 2 has an air outlet 8 communicating each of the chambers with the container body 1, and a first check valve 9 allowing air to enter only from the container body 1 into the chamber 7 is disposed in the air outlet 8. A piston 10 is disposed in each of the chambers 7 in a way that the piston 10 is slidable relative to each of the chambers 7. A closed cavity 71 is formed between a bottom wall of the chamber 7 and the piston 10 on which an air discharge structure is provided. The air discharge structure includes a valve mounting hole located at the center of the piston 10 and a third check valve 31 that is mounted in the valve mounting hole and allows the air to enter only from the closed cavity 71 to the outside through the valve mounting hole. When the piston 10 moves toward the first check valve 9, the closed cavity 71 communicates with the outside by the air discharge structure, and when the piston 10 moves away from the first check valve 9, a closed cavity 71 is formed between the piston 10 and the bottom wall of the chamber 7. By driving the piston 10 to move back and forth, the air in the container body 1 can be continuously drawn out. In this way, without any additional tools, the freshness preservation container itself has a vacuumizing function, therefore the usage is more convenient and practicability is better.

Referring to FIG. 6 and FIG. 7, in the accommodating slot 28, a linkage mechanism is linked to the two pistons 10 which move in opposite directions. The linkage mechanism includes a face cover 32 disposed in the accommodating slot 28 and a connecting rod 15 disposed between the face cover 32 and the bottom of the accommodating slot 28. There is a gap between the face cover 32 and a wall of the accommodating slot 28. The connecting rod 15 is detachably connected to the face cover 32 on the side facing the bottom of the accommodating slot 28, two ends of the connecting rod 15 are hinged at the pistons 10, and a middle portion of the connecting rod 15 is hinged at the container cover 2.

Figure 8:
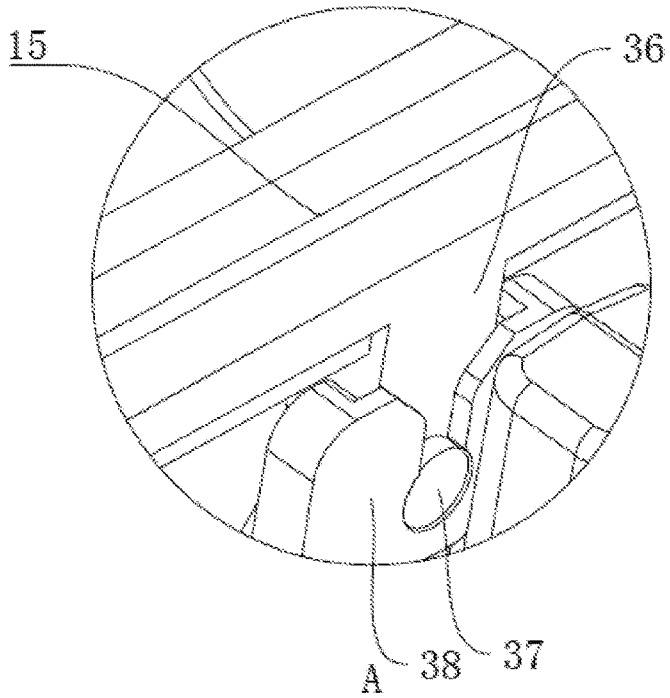
FIG. 8 is an enlarged view of A in FIG. 7.

Specifically, referring to FIG. 7 and FIG. 8, two first hinging lugs 36 are integrally formed at the middle of the connecting rod 15 on the lower side, and a first pin 37 is integrally formed on a side surface of each of the first hinging lugs 36. Two first hinging bases 38 which are located at the bottom of the accommodating slot 28 and have first hinging holes are integrally formed at the container cover 2. The two first pins 37 are respectively disposed into the first hinging holes of the first hinging bases 38 in a way that the first pins are rotatable relative to the first hinging holes. In order to facilitate the mounting of each first pin 37 into each first hinging hole, the first hinging base 38 has an indentation communicating with the first hinging hole on the top, and the width of the position where the indentation communicates with the first hinging hole is smaller than the diameter of the first pin 37. In this way, when each first pin 37 is disposed into the first hinging hole, it is only necessary to hold the connecting rod 15 and direct the first pin 37 at the indentation on the corresponding first hinging base 38, and then press the connecting rod 15 downward, such that the first pin 37 can pass through the indentation and enter into the first hinging hole.

Referring to FIG. 6 and FIG. 7, two second hinging lugs 39 are integrally formed at the connecting rod 15 at both ends, and a second pin 40 is integrally formed on a side surface of each second hinging lug 39. Two second hinging bases 41 having second hinging holes are integrally formed on the pistons 10. The second pin 40 is disposed into the second hinging hole of the second hinging base 41 in a way that the second pin 40 is rotatable relative to the second hinging hole. It should be noted that the second hinging hole is a waist-shaped hole in which the second hinging pin can slide.

Figure 9:
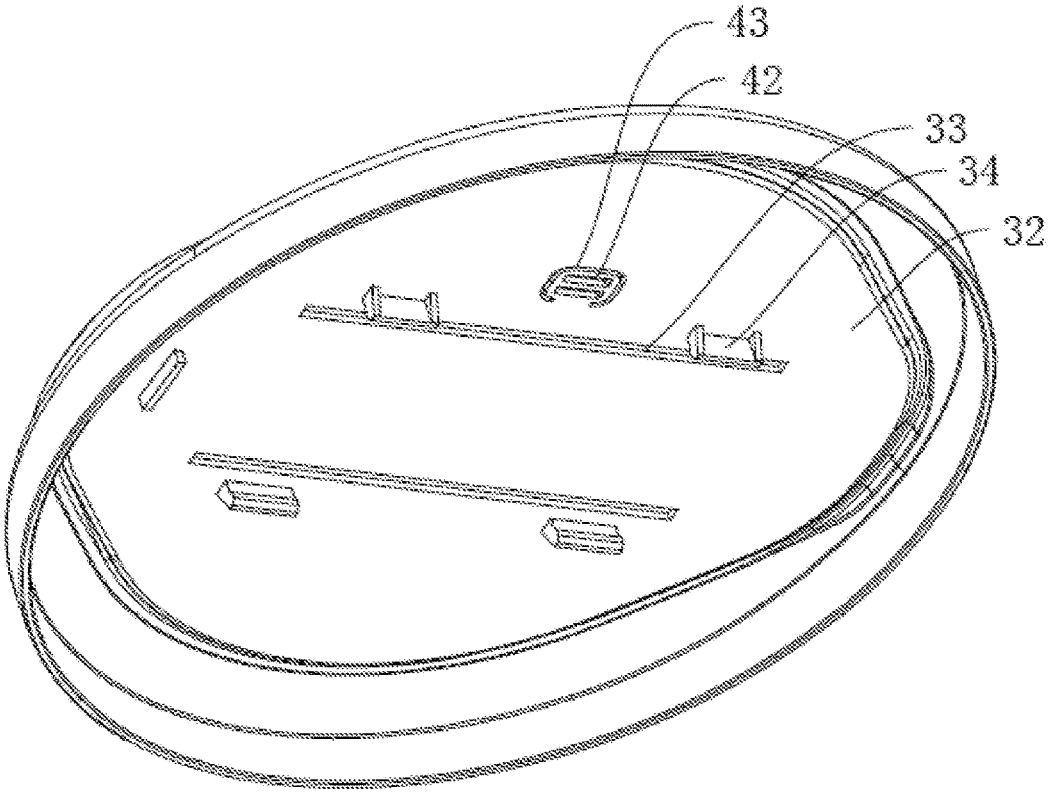
FIG. 9 is a structural schematic view of a face cover of Embodiment II of this application.

Referring to FIG. 7 and FIG. 9, positioning slots 33 and at least one group of snap-connection mechanism including two hooks 34 are disposed on one side of the face cover 32 facing towards the connecting rod 15 (two groups of snap-connection mechanisms are taken as an example in this embodiment); and the two ends of the connecting rod 15 are respectively connected to the two hooks 34 in snap fit fashion, positioning strips 35 are integrally formed on one side of the connecting rod 15 facing towards the face cover 32, and each positioning strip 35 is inserted into each positioning slot 33.

Figure 10:
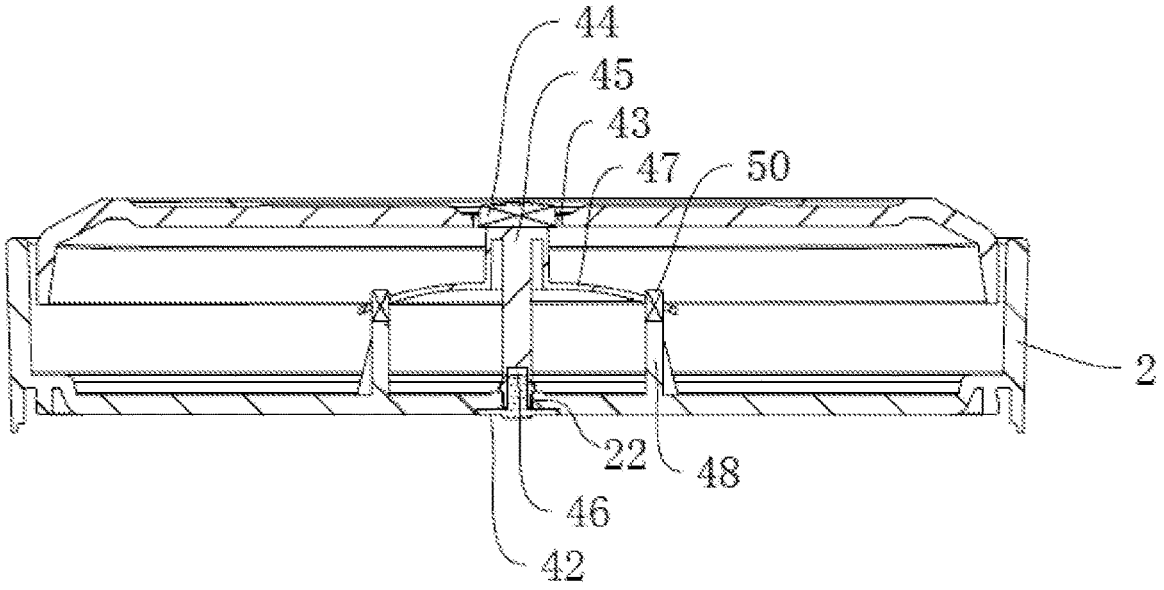
FIG. 10 is a sectional view showing a button, a transmission member and a fourth check valve of Embodiment II of this application.
Figure 11:
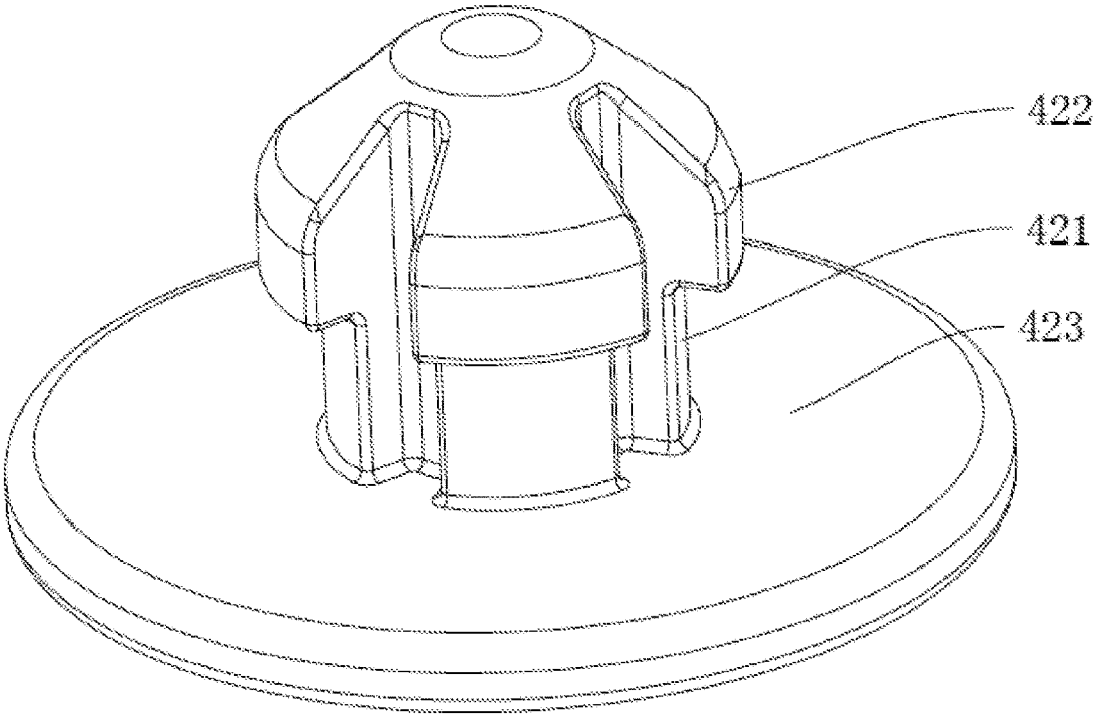
FIG. 11 is a structural schematic view of the fourth check valve of Embodiment II of this application.

Referring to FIG. 5, FIG. 10 and FIG. 11, the container cover 2 has an air inlet 22 located at the bottom of the accommodating slot 28 and under an extension line of an axis of the first pin 37. A fourth check valve 42 that allows air to enter only from the outside into the container body 1 is disposed in the air inlet 22. The fourth check valve 42 includes a cylindrical connecting portion 421 that passes through the air inlet 22, an anti-drop portion 422 integrally formed at the connecting portion 421 at one end facing the accommodating slot 28, and a sealing portion 423 integrally formed at the connecting portion 421 at one end away from the accommodating slot 28, and the sealing part 423 is pie-shaped; in addition, an air leakage groove runs through side walls of the connecting portion 421 and the anti-drop portion 422 to the sealing portion 423. It should be noted that when the fourth check valve 42 is disposed into the air inlet 22, the connecting portion 421 is in a tensioned state, such that when the pressure in container body 1 is negative, it is difficult for outside air to push the fourth check valve 42 and enter into the container body 1. Only by pressing a portion of the fourth check valve 42 exposed in the accommodating slot 28 toward the container body 1, the fourth check valve 42 can be opened, and the outside air can enter the container body 1 through the air inlet 22.

Referring to FIG. 9 and FIG. 10, in order to facilitate a user to press the fourth check valve 42, the face cover 32 has a button mounting hole 43 where a button 44 is disposed, and an elastic sheet is connected between the button 44 and the face cover 32. In addition, referring to FIG. 7 and FIG. 10, a transmission member 45 is further disposed between the button 44 and the fourth check valve 42 with one end of the transmission member 45 abutting the button 44 and the other end abutting the fourth check valve 42. It should be noted that one end of the transmission member 45 that abuts the fourth check valve 42 has a blind hole 46, and part of the fourth check valve 42 extends into the blind hole 46, such that the transmission member 45 and the fourth check valve are not easy to be detached. Two elastic members 47 integrally formed with the transmission member 45 are symmetrically disposed on a side wall of the transmission member 45; a supporting member 48 located at the bottom of the accommodating slot 28 for supporting each elastic member 47 is integrally formed on the container cover 2, and each elastic member 47 is detachably connected with each supporting member 48; specifically, the elastic member 47 has an inserting hole 49, an inserting pin 50 that fits the inserting hole 49 is formed on the supporting member 48, and the inserting pin 50 is inserted into the inserting hole 49.

The implementation principle of this embodiment is as follow. First the container cover 2 fits with the container body 1; then two sides of the face cover 32 are alternately pressed back and forth, such that the connecting rod 15 drives the two pistons 10 to move down in the two guiding rings 29, therefore the air in the container body 1 is continuously drawn out. When the container cover 2 needs to be opened later, first the button 44 is presses, such that the transmission 45 presses the fourth check valve 42 and then the fourth check valve 42 is opened, the outside air enters the container body 1 to balance the pressure inside and outside the container body 1; then the container cover 2 can be removed from the container body 1.

What is provided above is merely some preferred embodiments of this application. The scope of this application is not limited by the above embodiments, some improvements and modifications can be made by those skilled in the art without departing from the principle of this application, and should be considered to fall within the scope of this application.

What is claimed is:

1. A vacuum freshness preservation container comprising a container body and a container cover, wherein the container cover has chambers disposed symmetrically, a piston is slidably disposed in each chamber, each chamber has an air outlet which communicates with an interior of the container body and where a first check valve is disposed, the piston is provided with an air discharge structure that communicates the chamber with an outside when the piston moves toward the first check valve, and the container cover is provided with a linkage mechanism such that the two pistons move in opposite directions.

2. The vacuum freshness preservation container according to claim 1, wherein the linkage mechanism comprises a connecting rod with a middle portion connected to the container cover in a way that the middle portion is slidable relative to the container cover and two ends respectively hinged to the pistons.

3. The vacuum freshness preservation container according to claim 2, wherein the container cover has a mounting groove where the connecting rod is disposed, a top wall of the container cover has vertical slots which communicate with the chambers and are disposed above the chambers, and pushing blocks fixed at both ends of the connecting rod are disposed in vertical slots.

4. The vacuum freshness preservation container according to claim 3, wherein when the pushing blocks are at the same height, top surfaces of the pushing blocks are flush with a top surface of the container cover, and elastic members are disposed in the vertical slots to drive the pushing blocks to be flush with the top surface of the container cover.

5. The vacuum freshness preservation container according to claim 4, wherein the container body is provided with a pressing strip for pressing each pushing block, and one end of each pressing strip is rotatably connected to the container cover.

6. The vacuum freshness preservation container according to claim 2, wherein the linkage mechanism comprises a face cover which is detachably connected to one side of the connecting rod facing away from the face cover.

7. The vacuum freshness preservation container according to claim 6, wherein the container cover has an accommodating slot where the connecting rod and the face cover are located, and there is a gap between the face cover and a wall of the accommodating slot.

8. The vacuum freshness preservation container according to claim 7, wherein the container cover has an air inlet where a fourth check valve is disposed; the face cover is provided with a button, and a transmission member is disposed between the button and the fourth check valve; and the button is pressed to open the fourth check valve.

9. The vacuum freshness preservation container according to claim 8, wherein the fourth check valve comprises a connecting portion that passes through the air inlet, an anti-drop portion connected to the connecting portion at one end facing the accommodating slot and a sealing portion connected to the connecting portion at one end away from the accommodating slot, and an air leakage groove runs through side walls of the connecting portion and the anti-drop portion to the sealing portion.

10. The vacuum freshness preservation container according to claim 8, wherein an elastic member is fixedly connected to a side wall of the transmission member, a supporting member is fixedly connected to the container cover, and one end of the elastic member away from the transmission member is connected to the supporting member.

11. The vacuum freshness preservation container according to claim 1, wherein the air discharge structure comprises an annular groove, a gasket ring and a vent, a side wall of the piston has the annular groove on which the gasket ring is sleeved, the annular groove is formed with the vent communicating with the outside, and a width of the annular groove and a width of the vent are greater than a wire diameter of the gasket ring.

12. The vacuum freshness preservation container according to claim 1, wherein the container cover has an air inlet where a second check valve is disposed.

13. The vacuum freshness preservation container according to claim 1, wherein a pressure detecting member is mounted to the container cover.

14. The vacuum freshness preservation container according to claim 1, wherein the container body is provided with a rim on which a sealing ring abutting against the container cover is sleeved.

15. The vacuum freshness preservation container according to claim 1, wherein the container cover is provided with hinged hasps on both sides, and the container body is provided with fastening blocks for the hasps to be snapped into.

16. The vacuum freshness preservation container according to claim 1, wherein the air discharge structure has a valve mounting hole located on the piston and a third check valve disposed in the valve mounting hole.

* * * * *